US006236621B1

(12) United States Patent
Schettino

(10) Patent No.: US 6,236,621 B1
(45) Date of Patent: May 22, 2001

(54) PILLOW ALARM DEVICE

(76) Inventor: Cecilia C. Schettino, 154 Berwick Ave., Fairfield, CT (US) 06430

( * ) Notice: Subject to any disclaimer, the term of this patent is extended or adjusted under 35 U.S.C. 154(b) by 0 days.

(21) Appl. No.: 09/204,470

(22) Filed: Dec. 3, 1998

(51) Int. Cl.[7] ..... G04B 47/00; A47G 9/00

(52) U.S. Cl. ..... 368/10; 368/12; 5/639; 5/904

(58) Field of Search ..... 368/10, 12, 230, 368/243; 5/634, 639, 904

(56) References Cited

U.S. PATENT DOCUMENTS 5,072,429 * 12/1991 Mair ..... 368/10
5,089,998 * 2/1992 Rund ..... 368/72
5,144,600 * 9/1992 Cheng ..... 368/12
5,511,046 * 4/1996 Vanderpal ..... 368/63
6,010,192 * 1/2000 Ring ..... 297/397

* cited by examiner

*Primary Examiner*—Vit Miska

(57) ABSTRACT

A pillow alarm device for waking up a user. The device includes a pillow having a compartment therein with an alarm clock provided in the compartment. A vibrating device is also provided in the compartment. The vibrating device is adapted for vibrating the pillow to wake a user resting on the pillow when activated. The vibrating device is electrically connected to the alarm clock so that the alarm clock activates the vibrating device when an alarm of the alarm device is activated.

9 Claims, 3 Drawing Sheets

PILLOW ALARM DEVICE

BACKGROUND OF THE INVENTION

1. Field of the Invention

The present invention relates to pillow alarm devices and more particularly pertains to a new pillow alarm device for waking up a user.

2. Description of the Prior Art

The use of pillow alarm devices is known in the prior art. More specifically, pillow alarm devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,072,429; U.S. Pat. No. 4,093,944; U.S. Pat. No. Des. 338,798; U.S. Pat. No. 4,028,882; U.S. Pat. No. 2,512,641; and U.S. Pat. No. 3,835,640.

While these devices fulfill their respective, particular objectives and requirements, the aforementioned patents do not disclose a new pillow alarm device. The inventive device includes a pillow having a compartment therein with an alarm clock provided in the compartment. A vibrating device is also provided in the compartment. The vibrating device is adapted for vibrating the pillow to wake a user resting on the pillow when activated. The vibrating device is electrically connected to the alarm clock so that the alarm clock activates the vibrating device when an alarm of the alarm device is activated.

In these respects, the pillow alarm device according to the present invention substantially departs from the conventional concepts and designs of the prior art, and in so doing provides an apparatus primarily developed for the purpose of waking up a user.

SUMMARY OF THE INVENTION

In view of the foregoing disadvantages inherent in the known types of pillow alarm devices now present in the prior art, the present invention provides a new pillow alarm device construction wherein the same can be utilized for waking up a user.

The general purpose of the present invention, which will be described subsequently in greater detail, is to provide a new pillow alarm device apparatus and method which has many of the advantages of the pillow alarm devices mentioned heretofore and many novel features that result in a new pillow alarm device which is not anticipated, rendered obvious, suggested, or even implied by any of the prior art pillow alarm devices, either alone or in any combination thereof.

To attain this, the present invention generally comprises a pillow having a compartment therein with an alarm clock provided in the compartment. A vibrating device is also provided in the compartment. The vibrating device is adapted for vibrating the pillow to wake a user resting on the pillow when activated. The vibrating device is electrically connected to the alarm clock so that the alarm clock activates the vibrating device when an alarm of the alarm device is activated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pillow alarm device apparatus and method which has many of the advantages of the pillow alarm devices mentioned heretofore and many novel features that result in a new pillow alarm device which is not anticipated, rendered obvious, suggested, or even implied by any of the prior art pillow alarm devices, either alone or in any combination thereof.

It is another object of the present invention to provide a new pillow alarm device which may be easily and efficiently manufactured and marketed.

It is a further object of the present invention to provide a new pillow alarm device which is of a durable and reliable construction.

An even further object of the present invention is to provide a new pillow alarm device which is susceptible of a low cost of manufacture with regard to both materials and labor, and which accordingly is then susceptible of low prices of sale to the consuming public, thereby making such pillow alarm device economically available to the buying public.

Still yet another object of the present invention is to provide a new pillow alarm device which provides in the apparatuses and methods of the prior art some of the advantages thereof, while simultaneously overcoming some of the disadvantages normally associated therewith.

Still another object of the present invention is to provide a new pillow alarm device for waking up a user.

Yet another object of the present invention is to provide a new pillow alarm device which includes a pillow having a compartment therein with an alarm clock provided in the compartment. A vibrating device is also provided in the compartment. The vibrating device is adapted for vibrating the pillow to wake a user resting on the pillow when activated. The vibrating device is electrically connected to the alarm clock so that the alarm clock activates the vibrating device when an alarm of the alarm device is activated.

Still yet another object of the present invention is to provide a new pillow alarm device that has a vibrating device for vibrating the pillow to wake the user. This way the user is awoken by the alarm without waking up adjacent other sleepers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
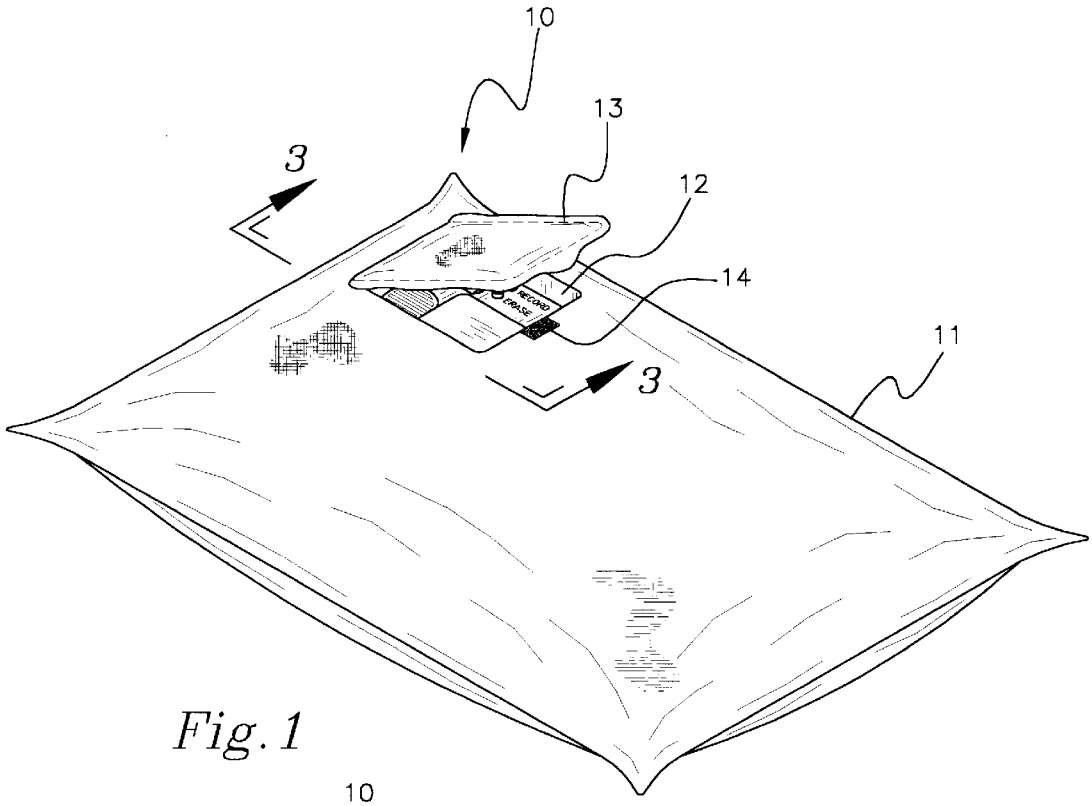
FIG. 1 is a schematic perspective view of a new pillow alarm device according to the present invention.
Figure 2:
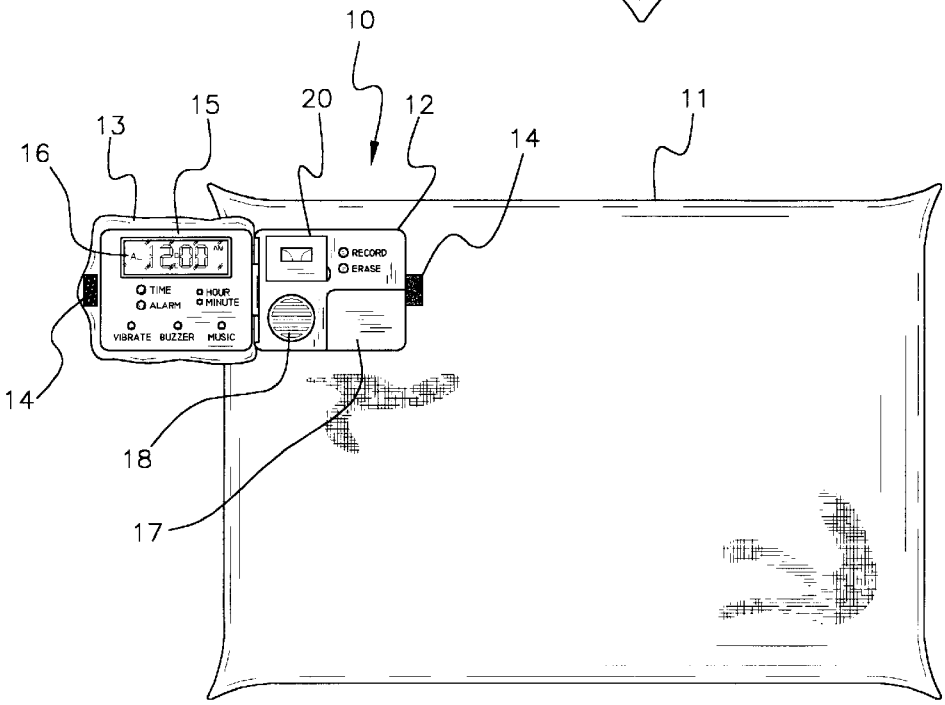
FIG. 2 is a schematic top side view of the present invention with the cover flap open.
Figure 3:
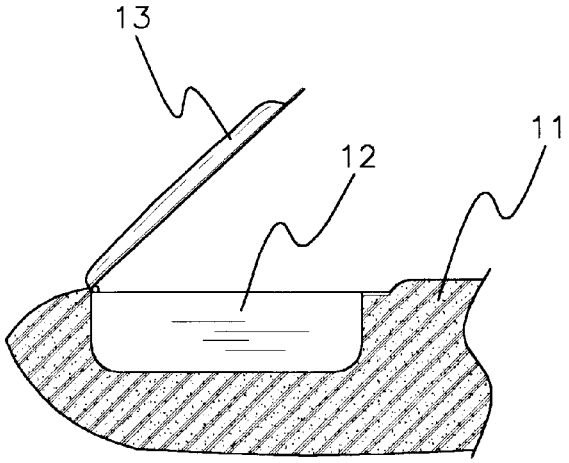
FIG. 3 is a schematic cross sectional view of the compartment of the present invention taken from line 3—3 of FIG. 1.
Figure 4:
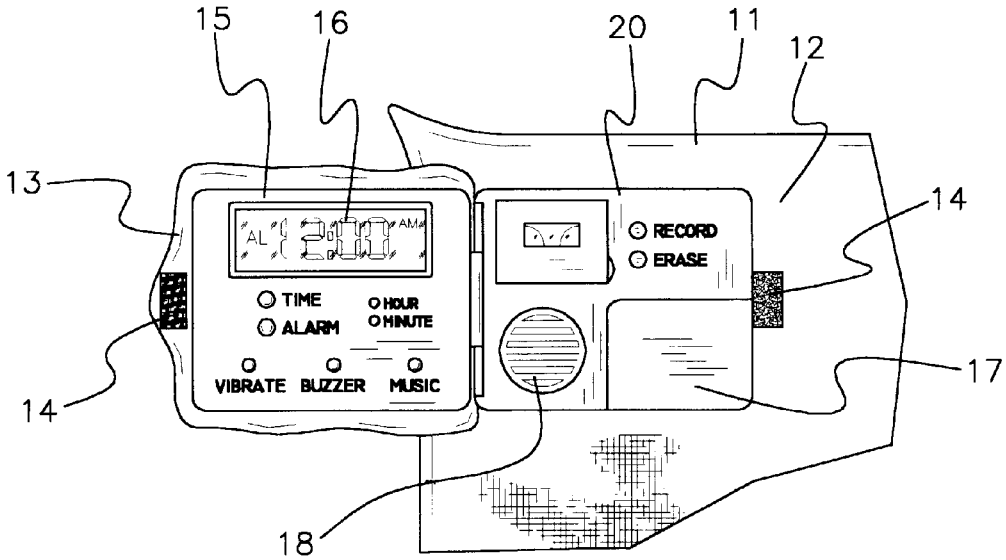
FIG. 4 is a schematic partial side view of the present invention.
Figure 5:
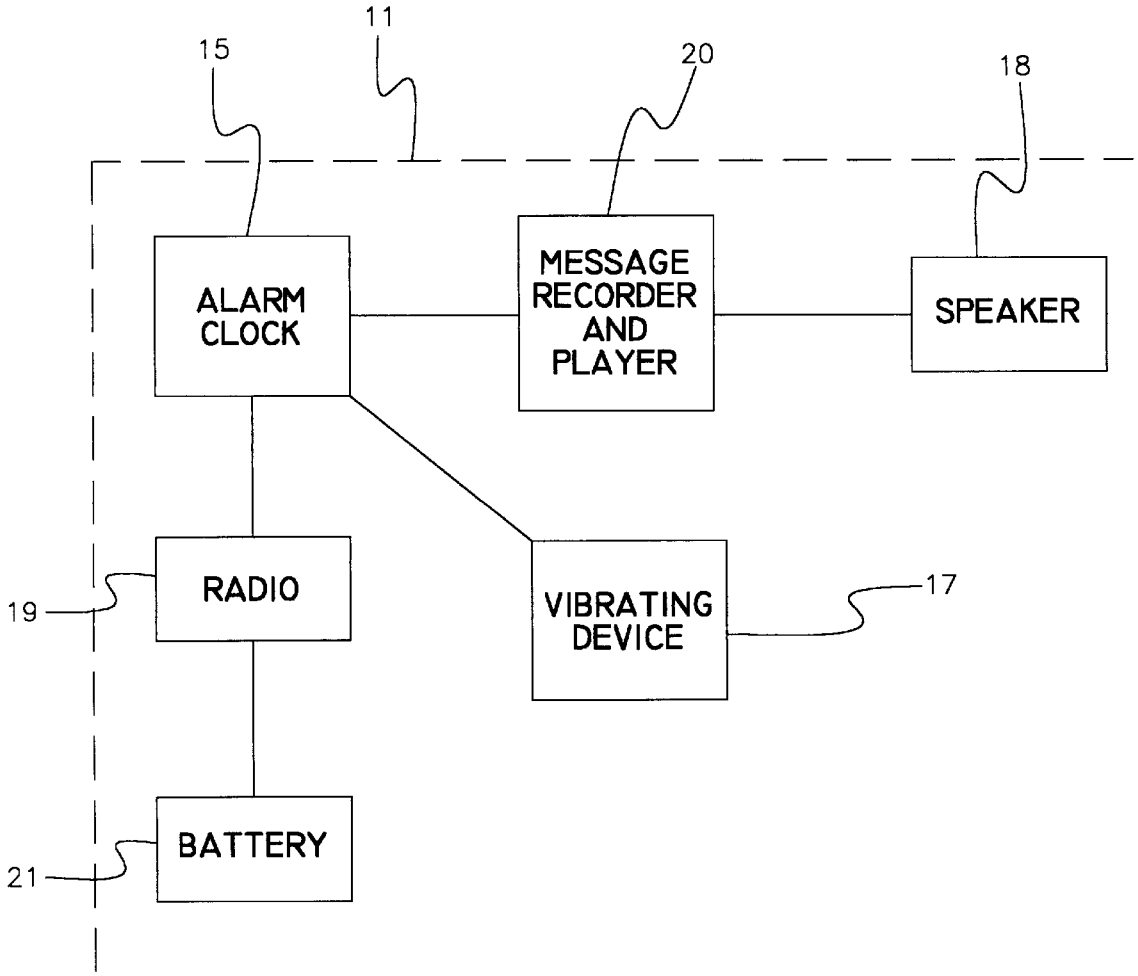
FIG. 5 is an illustrative schematic wiring diagram of the present invention.

With reference now to the drawings, and in particular to FIGS. 1 through 5 thereof, a new pillow alarm device embodying the principles and concepts of the present invention and generally designated by the reference numeral 10 will be described.

As best illustrated in FIGS. 1 through 5, the pillow alarm device 10 generally comprises a pillow 11 having a compartment 12 therein with an alarm clock 15 provided in the compartment 12. A vibrating device 17 is also provided in the compartment 12. The vibrating device 17 is adapted for vibrating the pillow 11 to wake a user resting on the pillow 11 when activated. The vibrating device 17 is electrically connected to the alarm clock 15 so that the alarm clock 15 activates the vibrating device 17 when an alarm of the alarm device is activated.

In closer detail, the pillow alarm device 10 comprises a pillow 11 has a plurality of corners and a compartment 12 therein. Preferably, the compartment 12 has a generally rectangular configuration and is located adjacent a corner of the pillow. The pillow 11 has a cover flap 13 pivotally coupled thereto and substantially covering the compartment 12. Ideally, a hook and loop fastener 14 attaches the cover flap 13 to the pillow 11 when the cover flap 13 covers the compartment 12.

An alarm clock 15 is mounted to the cover flap 13 such that the alarm clock 15 is positioned in the compartment 12 when the cover flap 13 covers the compartment 12. The alarm clock 15 has an alarm and a display 16 for displaying the time and the alarm time. Ideally, the display 16 is glow-in-the-dark so that it is visible in the dark by a user.

A vibrating device 17 is also provided in the compartment 12. The vibrating device 17 is adapted for vibrating the pillow 11 to wake a user resting on the pillow 11 when activated. The vibrating device 17 is electrically connected to the alarm clock 15. In use, the alarm clock 15 activates the vibrating device 17 when the alarm of the alarm device is activated. The alarm clock 15 has a speaker 18 for generating an audible sound. Ideally, a user may choose that the alarm of the alarm clock 15 generates a buzzer or other audible sound when activated. Preferably, when the alarm clock is set to activate the vibrator, no sound is generated by the alarm of the alarm clock. This way, the only alarm the user receives is from the vibrations of the vibrating device and thereby reduces the chance that adjacent other sleepers are awakened by the alarm. The alarm clock 15 may also include a radio 19 for receiving radio 19 signals. The radio 19 is electrically connected to the speaker 18 such that the speaker 18 generates audible sounds from the radio 19 signals. The radio 19 is also activatable by the alarm of the alarm clock 15.

A sound recording device 20 such as a tape recorder and player for recording a message from a user may also be provided in the compartment 12. The sound recording device 20 has a recorded sound playback device for playing back the message by the user. The recorded sound play back device is electrically connected to the speaker 18 such that the speaker 18 generate audible sounds corresponding to the recorded message. In use, a user may record a message on the sound recording device to be played back to the user after the alarm of the alarm clock goes off. For example, when the alarm goes off, the vibrating device is first activated to wake up the user. Then after a period of time the recorded sound playback device is activated to play a message that the user recorded when setting the alarm.

A battery power source 21 is also preferably provided in the compartment 12 for powering the vibrating device 17, the alarm clock 15, the radio 19, the speaker 18 and the sound recording device 20.

In use, the pillow alarm device 10 allows a user to be woken up by an alarm device in a manner that does not wake up others. The pillow alarm device also allows the user to record messages to remind the user about events or tasks that may be related to the activation of the alarm.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pillow alarm device comprising:

a pillow having a compartment therein;

an alarm clock being provided in said compartment;

a vibrating device being provided in said compartment, said vibrating device being adapted for vibrating the pillow to wake a user resting on the pillow when activated, said vibrating device being electrically connected to said alarm clock, said alarm clock activating said vibrating device when an alarm of the alarm device is activated;

wherein said compartment is located adjacent a corner of said pillow such that a head of a user of said pillow does not rest upon said alarm clock when said pillow is used by a user; and wherein said pillow has a cover flap pivotally coupled thereto and substantially covering said compartment, said alarm clock being mounted to said cover flap such that said alarm clock is positioned in said compartment when said cover flap covers said compartment.

2. The pillow alarm device of claim 1, wherein a hook and loop fastener attaches said cover flap to said pillow when said cover flap covers said compartment.

3. The pillow alarm device of claim 1, wherein said alarm clock has a speaker for generating an audible sound.

4. The pillow alarm device of claim 3, wherein said alarm clock has a radio for receiving radio signals, said radio being electrically connected to said speaker such that said speaker generates audible sounds from said radio signals, said radio being activatable by said alarm of said alarm clock.

5. The pillow alarm device of claim 1, further comprising a sound recording device for recording a message from a user being provided in said compartment, said sound recording device having a recorded sound playback device for playing back said message by the user, said recorded sound play back device being electrically connected to said speaker such that said speaker generate audible sounds corresponding to said recorded message.

6. The pillow alarm device of claim 1, wherein said cover flap has a time display mounted thereon such that said time display is viewable by the user while the user's head is resting on said pillow.

7. The pillow alarm device of claim 1, wherein said cover flap has a plurality of alarm clock controls mounted thereon such that said alarm clock controls are viewable by the user while the user's head in resting on said pillow.

8. The pillow alarm device of claim 1, wherein said cover flap has an inner surface, said cover flap being pivotally mounted on said pillow in a manner such that said inner surface is viewable by the user while the user's head is resting on said pillow.

9. A pillow alarm device, comprising:

a pillow having a plurality of corners and a compartment therein, said compartment having a generally rectangular configuration;

said pillow having a cover flap pivotally coupled thereto and substantially covering said compartment;

wherein a hook and loop fastener attaches said cover flap to said pillow when said cover flap covers said compartment;

an alarm clock being mounted to said cover flap such that said alarm clock is positioned in said compartment when said cover flap covers said compartment;

said alarm clock having an alarm and a display for displaying the time and the alarm time;

a vibrating device being provided in said compartment, said vibrating device being adapted for vibrating the pillow to wake a user resting on the pillow when activated, said vibrating device being electrically connected to said alarm clock, said alarm clock activating said vibrating device when the alarm of the alarm device is activated;

said alarm clock having a speaker for generating an audible sound;

said alarm clock having a radio for receiving radio signals, said radio being electrically connected to said speaker such that said speaker generates audible sounds from said radio signals, said radio being activatable by said alarm of said alarm clock;

a sound recording device being provided in said compartment for recording a message from a user, said sound recording device having a recorded sound playback device for playing back said message by the user, said recorded sound play back device being electrically connected to said speaker such that said speaker generate audible sounds corresponding to said recorded message;

a battery power source being provided in said compartment for powering said vibrating device, said alarm clock, said radio, said speaker and said sound recording device; and wherein said compartment is located adjacent one of said corners of said pillow such that a head of a user of said pillow does not rest upon said alarm clock when said pillow is used by a user.

* * * * *